US010214868B2

(12) United States Patent
Burzi et al.

(10) Patent No.: US 10,214,868 B2
(45) Date of Patent: Feb. 26, 2019

(54) COMPRESSIBLE SHOCK ABSORBER AND ASSOCIATED METHOD

(71) Applicant: TICOPTER SA, Agno (CH)

(72) Inventors: Marcello Burzi, La Morra (IT); Mauro Monteleone, Cassina d'Agno (CH)

(73) Assignee: TICOPTER SA, Agno (CH)

( * ) Notice: Subject to any disclaimer, the term of this patent is extended or adjusted under 35 U.S.C. 154(b) by 0 days.

(21) Appl. No.: 15/555,898

(22) PCT Filed: Mar. 4, 2016

(86) PCT No.: PCT/IB2016/051231

§ 371 (c)(1),
(2) Date: Sep. 5, 2017

(87) PCT Pub. No.: WO2016/139633

PCT Pub. Date: Sep. 9, 2016

(65) Prior Publication Data

US 2018/0051428 A1 Feb. 22, 2018

(30) Foreign Application Priority Data

Mar. 5, 2015 (IT) ..... RM2015A0100

(51) Int. Cl.
*E01F 15/00* (2006.01)
*E01F 15/14* (2006.01)

(52) U.S. Cl.
CPC ..... *E01F 15/146* (2013.01); *E01F 15/143* (2013.01)

(58) Field of Classification Search
CPC ..... E01F 15/143; E01F 15/146
USPC ..... 404/6
See application file for complete search history.

(56) References Cited

U.S. PATENT DOCUMENTS

| | | | | |
|---|---|---|---|---|
| 4,674,911 | A | 6/1987 | Gertz | |
| 6,116,805 | A | 9/2000 | Gertz | |
| 6,535,986 | B1 * | 3/2003 | Rosno | G06F 1/3203 713/400 |

(Continued)

FOREIGN PATENT DOCUMENTS

| | | | |
|---|---|---|---|
| FR | 2723603 | A1 | 2/1996 |
| KR | 20090006406 | A | 1/2009 |
| KR | 101146746 | B1 | 5/2012 |

OTHER PUBLICATIONS

PCT International Search Report and Written Opinion of the International Searching Authority, PCT/IB2016/051231, dated Sep. 9, 2016, 9 pages.

*Primary Examiner* — Raymond W Addie
(74) *Attorney, Agent, or Firm* — Fish & Richardson P.C.

(57) ABSTRACT

Compressible shock absorber (100), characterized in that it includes at least one pair of shock absorbing elements (110) co-axial and telescopic reciprocally sliding along a longitudinal sliding axis (X); said shock absorbing elements (110) co-axially include a cavity (115) and include therein a compressible air volume during their axial sliding reciprocal between a first position of maximum axial extension and a second position of lower axial extension; said at least one pair of shock absorbing elements (110) includes air extractors (140) susceptible of allowing an extraction of the air from said internal volume progressive with the reduction of the axial extension following the impact of a vehicle against said shock absorber.

12 Claims, 3 Drawing Sheets

(56) References Cited

U.S. PATENT DOCUMENTS

| | | | | |
|---|---|---|---|---|
| 6,604,888 | B2 * | 8/2003 | Dolan | E01F 15/146 404/10 |
| 6,811,144 | B2 * | 11/2004 | Denman | E01F 15/146 256/13.1 |
| 2005/0211520 | A1 * | 9/2005 | Abu-Odeh | B62D 21/15 188/377 |
| 2010/0080652 | A1 | 4/2010 | Shin | |
| 2016/0024732 | A1 * | 1/2016 | Impero | E01F 15/146 256/13.1 |

* cited by examiner

COMPRESSIBLE SHOCK ABSORBER AND ASSOCIATED METHOD

CLAIM OF PRIORITY

This application is a U.S. National Phase Application under 35 USC § 371 and claims the benefit of priority to International Patent Application Serial No. PCT/IB2016/051231, filed on Mar. 4, 2016, which claims priority to Italian Application Serial No. RM2015A000100, filed Mar. 5, 2015, the entire contents of which are hereby incorporated by reference.

FIELD OF THE TECHNIQUE

The concepts herein relates to the field of the shock absorbers and in detail concerns a compressible shock absorber preferably for highway use.

KNOWN ART

One of the principal problems that are found in the fast travelled roads, or highways, relates to front impacts, that is those impacts wherein a vehicle frontally impacts against a barrier.

In particular, it is observed that the frontal shock is particularly critical in correspondence of junctions, wherein the road divides in two branches. In correspondence of the junction the internal barriers join one to the other in correspondence of the union of the two branches of the road forming an acute angle; this is particularly dangerous in terms of shock. A frontal shock against a barrier can easily bring to deadly accidents.

Clinical studies have demonstrated that is not quite the shock per se as being the cause of corporal injuries on the driver or on the passengers of the vehicle, but is more the deceleration that follows the impact to bring to the crushing and/or rupture of the internal organs that in many cases is compromising.

Different types of protections suitable for realizing shock absorbers have been developed.

The document U.S. Pat. No. 6,116,805 shows a shock absorber of a compressible type, that is that is composed by a plurality of deformable elements.

Said shock absorber has the drawback that said deformable elements shall be replaced following of the impact. Consequently at each impact, the cost relating to the substitution of the elements becomes considerable and not negligible.

From document U.S. Pat. No. 4,674,911 it is known a reusable shock absorber with deformable elements. Said document teaches the use of a plurality of pneumatic cells, subdivided by pneumatic valves of complex construction.

At the impact, said pneumatic valves seriously risk of being damaged, and their constitution so fragile renders high the cost of the device.

Nonetheless, the attenuation of the shock is not progressive in the impact since there is a compression of the valves with following blockage of the light of extraction of the air.

Finally, in case of shocks of relevant entity, there is the concrete risk of damaging and piercing of the foldable pneumatic cells, which implies new substitutions.

From document KR101146746 it is known an apparatus for absorbing the impact of a colliding vehicle.

It is therefore object of the concepts herein to describe a device of shock absorption which is exempt from the aforementioned drawbacks.

A further scope of the concepts herein is to describe a method of attenuation of shocks which concurs to solve the aforementioned drawbacks.

SUMMARY

According to the concepts herein is realized a compressible shock absorber, characterized in that it comprises at least one pair of co-axial and telescopic shock absorbing elements reciprocally sliding along a longitudinal sliding axis X; said co-axial shock absorbing elements comprise therein an air volume which is compressible during their reciprocal axial sliding between a first position of maximum axial extension and a second position of lower axial extension; said at least one pair of shock absorbing elements defines therein an substantially continuous internal air volume and comprises air extractors susceptible of allowing an extraction of the air from said internal volume progressive with the reduction of the axial extension following the impact of a vehicle against said shock absorber, and is in said position of maximum axial extension following of a shock.

The air extractors are advantageously realized by a dimensional difference between a first and a second shock absorbing element of the said pair of co-axial shock absorbing elements.

In detail, said dimensional difference is measured at the level of diameter.

In detail said air extractors are an annular free portion external with respect to the lateral surface of one of the two shock absorbers of the said pair, and internal to the lateral surface of the other shock absorber of the said pair wherein the first shock absorber inserts.

According to an aspect of the concepts herein, said shock absorber is characterized in that it is repositionable in said position of maximum axial extension following of a shock.

In a further aspect of the concepts herein, said shock absorber is characterized in that it comprises a plurality of guides for said shock absorbing elements; said guides being positioned in correspondence of a lower portion of a supporting structure of said shock absorbing elements.

Advantageously, at least one of said shock absorbing elements comprises a head portion comprising a junction element rigidly hinged to the body of said shock absorbing element and provided with a device of sliding engagement on said guides.

Advantageously, said guides are positioned on both the sides of said shock absorbing element and comprise a hole within which a lower bar of the supporting structure is introduced.

Advantageously said shock absorber is configured for having said dimensional difference as being inversely proportional to the length of said shock absorbing element and/or to the overall number of elements and/or pairs of shock absorbers.

Advantageously said supporting structure is anchored on the ground by plugs and/or micropiles exempt by concrete counter support.

Advantageously, said shock absorber comprises a pair of guardrails being positioned laterally along at least part of the length of the supporting structure.

Said guardrails provide for giving an help in the deviation of the trajectory of a vehicle laterally impacting respective to the structure of said guardrail.

Advantageously, said air extractors are of a different sixe for each pair of shock absorbing elements and realize an extractor of progressive deceleration in case of shock.

Advantageously, each of said shock absorbing element is substantially open in correspondence of at least one own end portion.

According to the concepts herein is realized a method of attenuation of shock, that comprises interposing between said vehicle and said obstacle at least one pair of coaxial and telescopic shock absorbing elements, both oriented in a same direction defined by a longitudinal axis, wherein said shock absorbing elements have bodies with different sizes suitable for being introducible at least partially one into the other defining a space between the inner body and the outer body that defines that enables extraction of an air volume contained within said bodies; said method comprising a step of axial compression of the assembly formed by the at least said pair of shock absorbing elements that causes a compression of said air volume that in turn exits in a controlled way from said space, and a subsequent step of repositioning of said shock absorbing elements respective to a position of maximum axial extension.

Advantageously, said method comprises furthermore a step of positioning of at least a further co-axial and telescopic shock absorbing element with the preceding pair of shock absorbing elements.

Advantageously, said method comprises furthermore a step of positioning of a supporting structure on a road, a step of firm bonding of the said supporting structure by piles or plugs exempt by concrete structure on the base, and a subsequent step of caging of the plurality of shock absorbing elements so as to guide linearly the reciprocal sliding thereof along said longitudinal axis.

DESCRIPTION OF THE FIGURES

The concepts herein will be hereinafter described in a preferred and non-limiting embodiment and with reference to the annexed figures wherein.

The hereinafter shown embodiments are to be intended as preferred and non-limiting.

DETAILED DESCRIPTION

Figure 1:
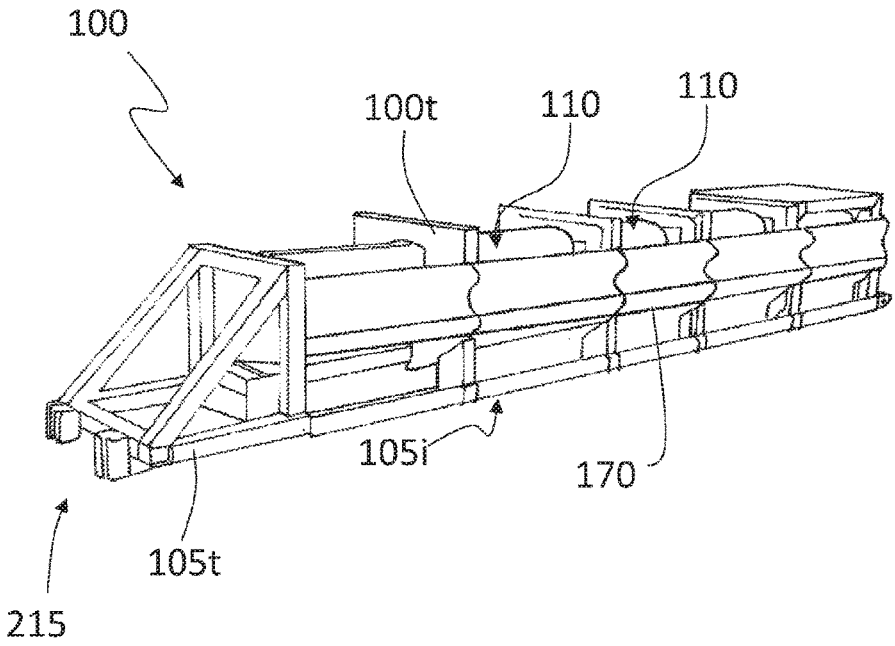
FIG. 1 schematically shows a perspective view of a first embodiment of the shock absorber object of the concepts herein.
Figure 2:
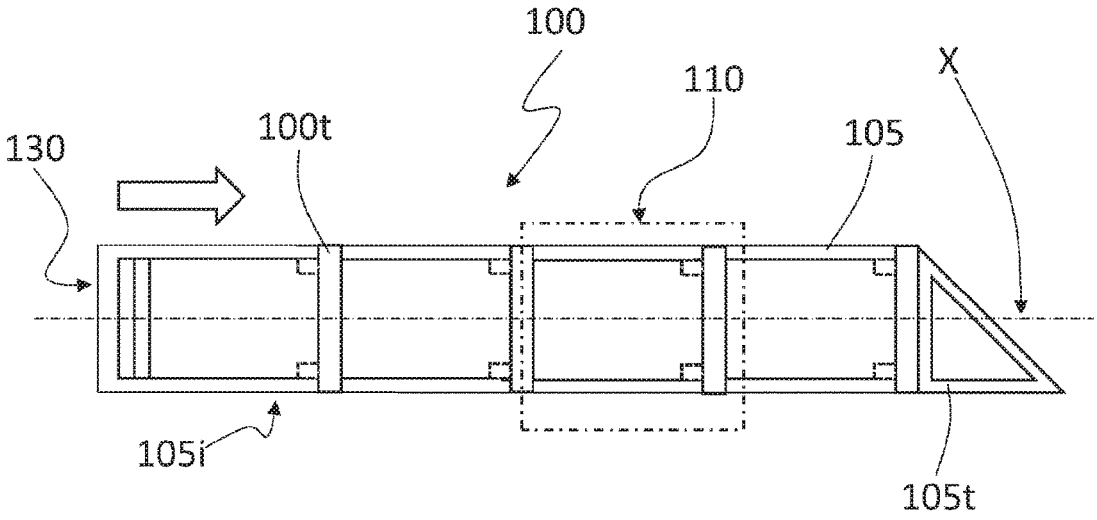
FIG. 2 shows a lateral section view of the attenuator object of the concepts herein.

With the reference number 1 in FIG. 1 is shown in its complex a first preferred and non-limiting embodiment of a compressible shock absorber.

The shock absorber 100 is conceived for allowing the reduction of the force of impact of the deceleration of a vehicle against an obstacle—in particular but in a non-limiting extent on fast travelled roads or on highways—up to reaching a level so as to not to provoke deadly injuries on the human body.

In detail, the shock absorber 100 comprises a supporting structure 105 within which at least two shock absorbing elements 110 of a preferably but in a non-limiting extent at least partially cylindrical shape are inserted.

The figures annexed to the present description show an embodiment having four shock absorbing elements; said number shall not be intended as limiting.

The shock absorbers 110 are installed in such a way to result co-axial and telescopic, oriented that is in such a way to have a direction of maximum extension along a common longitudinal axis.

The shock absorbers 110 linearly slide on said supporting structure 105 between a first position of maximum axial extension wherein only a minimum portion of each of them is introduced within the contiguous shock absorbing element 110, and one or more positions of lower axial extension, following an impact, into which proportionally greater portions of each shock absorbing element 110 are introduced within the contiguous shock absorbing element following of a shock or impact of a vehicle against a head portion 130 of the attenuator object of the concepts herein.

Figure 3:
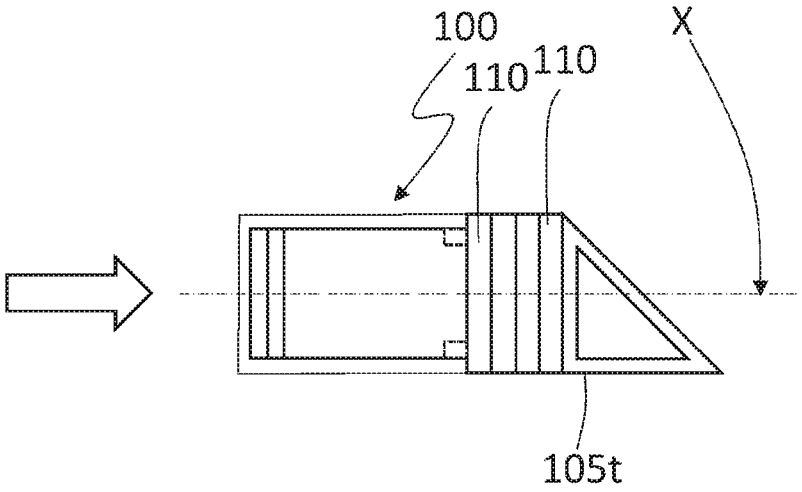
FIG. 3 shows a lateral section view of the attenuator object of the concepts herein in case in "full compressed" configuration following an impact of significant relevance.
Figure 4:
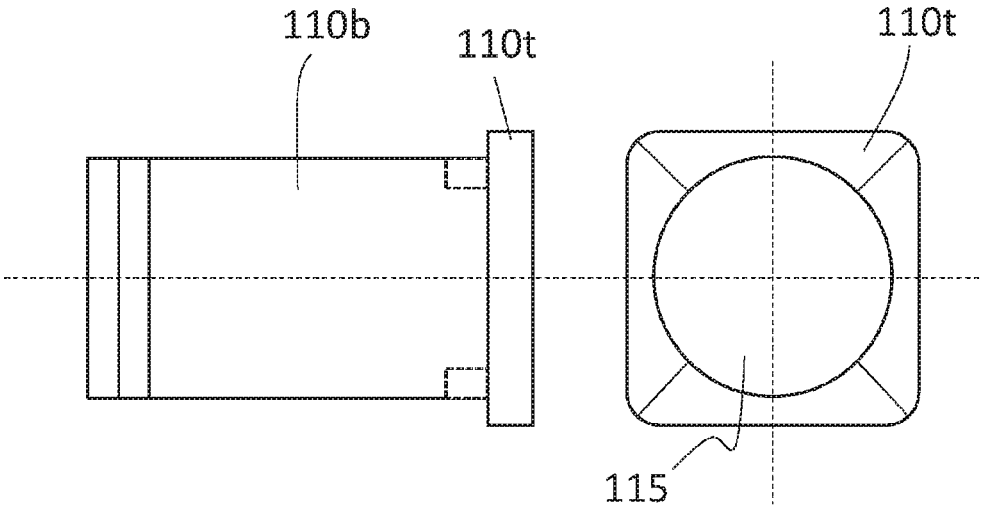
FIG. 4 shows a front and lateral view of a shock absorbing element being part of the attenuator object of the concepts herein.

The supporting structure ends with a tail portion **105*t* triangular-shaped that is configured to the end of realizing a contrasting element in case all the shock absorbing elements 110 are arranged in position of maximal axial compression as it is shown in FIG. 3**.

In detail each of the shock absorbing elements 110, that comprises a tubular portion **110*b* joined to a head section 110*t*, has an internal cavity 115 within which there is an air volume apt to be compressed in case of impact. Said air volume, into the compression between the first position of maximum axial extension and any of the remaining position of lower axial extension, reduces, and the air contained in the cavity of the shock absorbing elements 110 exits from these last passing through of the orifices 140 of extraction of the air. Said orifices of extraction of the air 140** realize air extractors constantly open and susceptible of allowing an extraction of the air from said internal volume progressively with the reduction of the axial extension following the impact of a vehicle against said shock absorber.

In other words, said orifices ideally keep their size unaltered during the shock, excepting transversal deformations of the tubular portion **110*b* that anyway should not happen. In detail, the orifices of extraction of the air 140** are annular apertures that there are due to the difference of a diameter between a shock absorbing element and the other in case reciprocally introduced.

The applicant has observed that the absence of perforated plates or other closure elements of any shock absorbing element 110 helps the setting of the right amount of air that exits from the orifices of extraction of the air 140 represented by the annular apertures deriving from the difference of diameter between one portion and the other.

Nonetheless, the absence of perforated plates or of other closure elements allows the axial sliding of the various shock absorbing elements 110 freer, and they can compact more one with the other.

The absence of perforated plates or other elements of closure on the shock absorbers 110 provide the device herein described significantly more economic with respect to the competitors.

For said reason each shock absorbing element 110 has substantially open ends substantially; with the term "substantially open" it is meant ends without holed closure elements such as to significantly reduce the area within which the air can pass between a shock absorbing element and the contiguous one/s. This clearly is valid for the intermediate shock absorbing elements; those which are terminal, for containing the air volume, shall necessarily being substantially or better totally closed in correspondence of their ends. Anyway, in case device described in the concepts herein has only two shock absorbing elements 110, said elements, even though being configured in a configuration of maximum axial extension or any other configuration of non-maximal axial extension, define therein a substantially continuous compressible air volume, that is in a single chamber.

Figure 5:
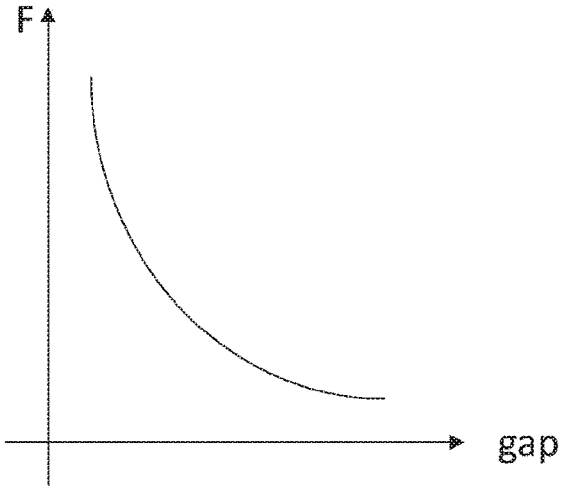
FIG. 5 shows a force F diagram of deceleration in relation to the size of orifices of extraction of the air from the internal volume of the tubular elements.

As it is shown in FIG. 5, given a number n of shock absorbing elements 110, the force F necessary to the axial compression of the assembly of the various shock absorbing elements, that is then the force that opposes vehicle at the moment of the shock or impact itself and into the subsequent deceleration, is inversely proportional to the size of the orifices 140.

Figure 6:
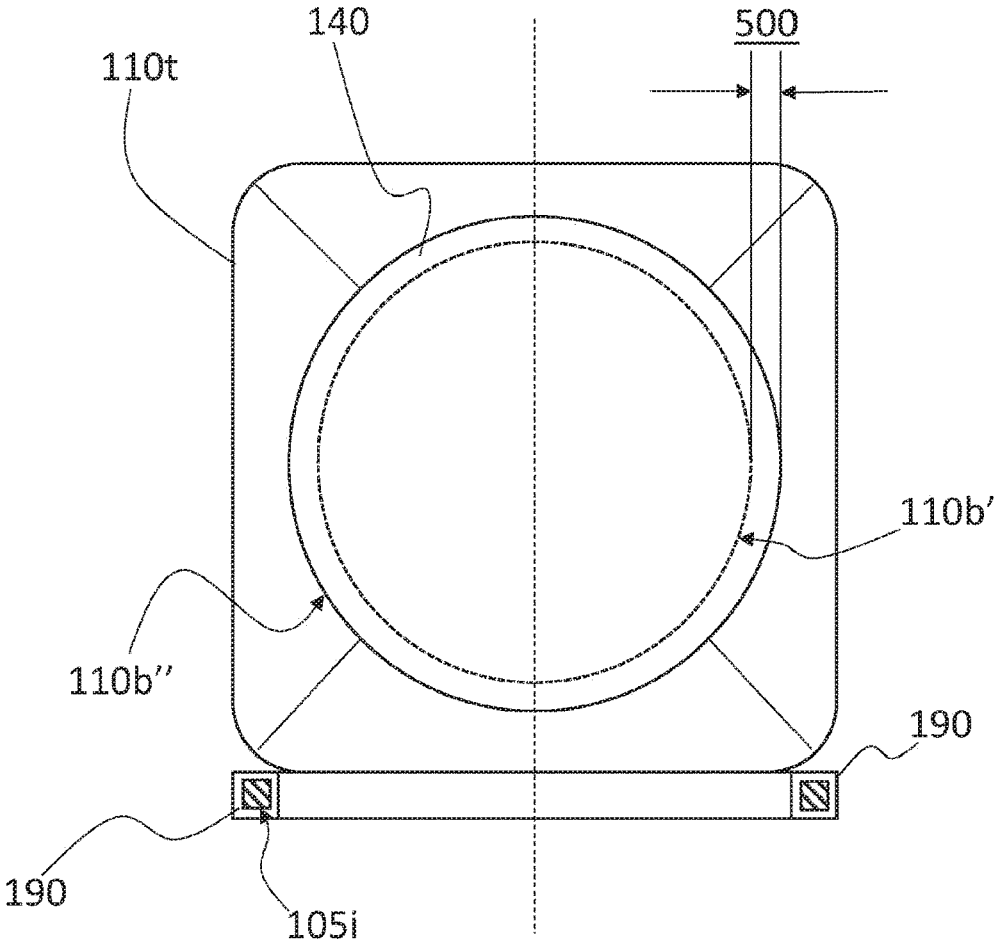
FIG. 6 a detail of a front portion of a shock absorbing element of the attenuator object of the concepts herein.

As it is shown in FIG. 6, therefore, a tubular body 110*b*' of a first shock absorbing element 110 is introduced within the tubular portion 110*b*" of a second element shock absorber 110 leaving an annular clearance 500 that precisely detects said orifice 140 of air extraction. The size of the orifices 140 is calculated on the number n of elements and according to the length of each of those, being capable therefore of playing on two substantially independent variables for defining the maximum force of resistance to the impact of the vehicle.

In any case the force F necessary to the compression of the assembly of the various shock absorbing elements 110 keeps almost constant along all the interval of axial compression of the assembly of the shock absorbing elements 110.

On the lateral portions of the supporting structure there is a guardrail 170, that is configured for deviating the trajectory of vehicle in case impacting against the device object of the concepts herein not frontally but from a lateral direction. The guardrail 170 is configured in a plurality of sections which are juxtaposed along a direction of maximum extension that extends parallel to the axis X.

The shock absorber 100 object of the concepts herein does not necessitate of a ground installation with blocks of concrete.

The supporting structure 105 is in fact configured for being installed on the road ground by plugging and/or micropiles. Advantageously this brings to a reduction of the costs of realization of the attenuator 100 respective to those that instead necessitate of said ground installation with blocks of concrete.

The shock absorber 100 object of the concepts herein is characterized in that it comprises a plurality of guides 190 for said shock absorbing elements 110; said guides being positioned in correspondence of a lower portion of a supporting structure of said shock absorbing elements.

Advantageously the guides 190 are realized with a section bar, whose exemplificative and non-limiting embodiment is shown in FIG. 6, having a pair of holes that engage in lower bars of the supporting structure 105, allowing therefore a translation of the various shock absorbing elements 110 along the direction defined by the axis X.

The presence of a guide 190 with holes that engage on the lower bars 105*i* of the supporting structure 105 on both the sides of the device object of the concepts herein advantageously allows of realizing a more rigid attenuator, less subject to twisting at the moment of the impact with the vehicle, with subsequent greater progressivity of deceleration of this last. The attenuator 100 object of the concepts herein comprises finally a pair of jaws 215, positioned in correspondence of the tail portion 105*t* that in use are used for being fixed to eventual guardrails or similar yet present on the road.

In use, therefore, in case a vehicle impacts against the attenuator object of the concepts herein, at first it impacts starting from the head section 130, progressively compressing the assembly of the shock absorbing elements 110 along the direction of the axis X and making the guides 190 slide along the lower bars 105*i* of the supporting structure into the same direction; the lower bars realize guiding rails for the shock absorbing elements. Is not in particular compulsory that following of the shock the direction of the shock absorbing elements 110 is such to bring the respective head portions 110*t* "fully compressed" the a against the other. In contrast, the design of the overall axial length of the cylindrical bodies 110*b* and/or of their overall number in relation to the clearance 500 of the orifices 140 shall be so as to render only the most important shocks those that bring the head portions 110*t* "fully compressed".

According to an aspect particularly advantageous of the concepts herein, the clearances 500 of the orifices 140 are greater as long as we move towards the head portion of the attenuator 100 object of the concepts herein, and smaller as moving, in contrast, towards the tail section. In such a way, advantageously, the deceleration of the vehicle in case of impact is rendered more progressive, being lower in the first instants following the impact and increasingly greater in the subsequent instants. This brings a lower risk of rollover of the vehicle and therefore indirectly a greater safety for the passengers thereof.

Following of the shock the various shock absorbing elements 110 are repositioned into the initial position of maximum axial extension, and the device object of the concepts herein is newly ready for being usable.

It is finally clear that to the shock absorber object of the concepts herein additions, adaptations or variants obvious for a skilled person can be applied without for this departing from the scope of protection provided by the annexed claims.

The invention claimed is:

1. A compressible shock absorber, comprising:

at least one pair of co-axial and telescopic shock absorbing elements reciprocally slideable along a longitudinal sliding axis; said co-axial shock absorbing elements comprise a cavity and comprise therein a compressible air volume during their reciprocal axial sliding between a first position of maximum axial extension and a second position of lower axial extension; said at least one pair of shock absorbing elements defines therein an internal substantially continuous air volume and comprises air extractors susceptible of allowing an extraction of the air from said internal volume progressive with the reduction of the axial extension following the impact of a vehicle against said shock absorber; said air extractors, that are constantly open, are realized by a dimensional difference between a first portion of the body of a first shock absorbing element of said at least two co-axial shock absorbing elements and a second portion of the body of a second shock absorbing element of said at least two co-axial shock absorbing elements.

2. The shock absorber according to claim 1, wherein said air extractors are an external free annular portion with respect to the lateral surface of one of the two shock absorbing elements of said pair, and internal to the lateral surface of the other shock absorbers of said pair where the first shock absorbing element introduces therein.

3. The shock absorber according to claim 1, comprising furthermore a pair of guardrail arranged laterally along at least part of the length of the supporting structure.

4. The shock absorber according to claim 1, wherein said air extractors are of size which differs for every pair of shock absorbing elements and realize extractors for progressive deceleration in case of shock.

5. The shock absorber according to claim 1, wherein that each of said shock absorbing elements is substantially open in correspondence of at least one end portion thereof.

6. The shock absorber according to claim 1, wherein said dimensional difference is measured at a level of the diameter of a tubular body of said shock absorbing element.

7. The shock absorber according to claim 6, wherein said dimensional difference is inversely proportional to the length of said shock absorbing element and/or to the overall number of elements and/or pairs of shock absorbers.

8. The shock absorber according to claim 1, comprising a plurality of guides for said shock absorbing elements; said guides being positioned in correspondence of a lower portion of a supporting structure of said shock absorbing elements.

9. The shock absorber according to claim 8, wherein at least one of said shock absorbing elements comprises a head portion in turn comprising a junction element rigidly jointed to the body of said shock absorbing element and provided with an engagement device on said lower portion of the supporting structure.

10. The shock absorber according to claim 8, wherein said guides are positioned on both the sides of said compressible shock absorber and comprise a hole within which is introduced a lower bar of the supporting structure.

11. A method of attenuation of the force of impact of a vehicle against an obstacle, said method comprising:

interposing between said vehicle and said obstacle at least one pair of shock absorbing elements co-axial and telescopic, both oriented in a same direction defined by a longitudinal axis, wherein said shock absorbing elements have bodies having different sizes so as to introduce at least partially one within the other defining a space between the internal body and the external body that defines air extractors of an air volume which is contained within said bodies; said method comprising a step of axial compression of the assembly formed by the at least said pair of shock absorbing elements that causes a compression of said air volume that in turn exits in a controlled way from the air extractors and a subsequent step of repositioning of said shock absorbing elements respective to a position of maximum axial extension.

12. The method according to claim 11, comprising a step of positioning of at least a further coaxial and telescopic shock absorbing element with the preceding pair of shock absorbing elements.

* * * * *